US010112801B2

(12) United States Patent
Madarasz et al.

(10) Patent No.: US 10,112,801 B2
(45) Date of Patent: Oct. 30, 2018

(54) ELEVATOR INSPECTION APPARATUS WITH SEPARATE COMPUTING DEVICE AND SENSORS

(71) Applicants: Richard Laszlo Madarasz, Tempe, AZ (US); Kathleen Mary Mutch, Tempe, AZ (US)

(72) Inventors: Richard Laszlo Madarasz, Tempe, AZ (US); Kathleen Mary Mutch, Tempe, AZ (US)

( * ) Notice: Subject to any disclaimer, the term of this patent is extended or adjusted under 35 U.S.C. 154(b) by 496 days.

(21) Appl. No.: 14/814,052

(22) Filed: Jul. 30, 2015

(65) Prior Publication Data

US 2017/0029244 A1 Feb. 2, 2017

Related U.S. Application Data

(60) Provisional application No. 62/033,235, filed on Aug. 5, 2014.

(51) Int. Cl.
*B66B 1/34* (2006.01)
*B66B 5/00* (2006.01)

(52) U.S. Cl.
CPC ..... *B66B 5/0037* (2013.01)

(58) Field of Classification Search
CPC ..... B66B 5/0037
USPC ..... 187/247, 277, 391, 393; 324/750.16, 324/750.22, 750.23, 160, 162
See application file for complete search history.

(56) References Cited

U.S. PATENT DOCUMENTS

| | | | |
|---|---|---|---|
| 3,781,901 | A | 12/1973 | Morrison |
| 4,002,973 | A | 1/1977 | Wiesendanger et al. |
| 4,330,838 | A | 5/1982 | Yoneda et al. |
| 4,418,795 | A | 12/1983 | Trosky et al. |

(Continued)

FOREIGN PATENT DOCUMENTS

| | | | |
|---|---|---|---|
| EP | 0367388 | A1 | 5/1990 |
| KR | 20040106077 | A | 12/2004 |
| KR | 100758152 | B1 | 9/2007 |

OTHER PUBLICATIONS

National Elevator Industry, Inc., Building Transportation Standards and Guidelines, "Performance Technology Matrix", pp. 5-3 to 5-11, Oct. 30, 2013, www.neii.org.

(Continued)

*Primary Examiner* — Anthony Salata

(57) ABSTRACT

The present invention is an elevator inspection apparatus. It comprises a sensor package, a commercially available off-the-shelf computing device, a computer program, and a communication mechanism between the sensor package and the computing device. The sensor package is physically separate from the computing device, comprising a sensor for measuring the acceleration of the elevator car, a door position sensor for determining the position of the elevator door, a sensor for measuring the altitude of the elevator car, and an interface to an external communication mechanism for communicating with the computing device. The computing device includes an interface to an external communication mechanism for communicating with and providing power to the sensor package. The computer program controls the apparatus, analyzes the signals from the sensor package, displays the results of the analysis, and creates reports of the elevator performance.

11 Claims, 12 Drawing Sheets

(56) References Cited

U.S. PATENT DOCUMENTS 4,458,788 A 7/1984 LePore
4,512,442 A 4/1985 Moore et al.
4,697,243 A 9/1987 Moore et al.
4,874,063 A * 10/1989 Taylor ..... B66B 5/0006 187/391
4,930,604 A 6/1990 Schienda et al.
5,027,299 A 6/1991 Uetani
5,042,621 A 8/1991 Ovaska et al.
5,257,176 A 10/1993 Uetani
5,431,252 A 7/1995 Morrison
5,522,480 A 6/1996 Hofmann
5,760,350 A 6/1998 Pepin et al.
5,787,020 A 7/1998 Molliere et al.
5,817,994 A 10/1998 Fried et al.
6,330,935 B1 12/2001 Systermans
6,516,923 B2 * 2/2003 Lence Barreiro ..... B66B 13/22 187/247
6,543,583 B1 * 4/2003 Lence Barreiro ..... B66B 5/0025 187/316
6,604,611 B2 8/2003 Liu et al.
7,004,289 B2 * 2/2006 Shrum, III ..... B66B 5/0037 187/393
7,073,633 B2 * 7/2006 Weinberger ..... B66B 5/0025 187/247
7,222,698 B2 5/2007 Hanninen
7,699,142 B1 4/2010 Wurth et al.
7,712,587 B2 5/2010 Kim et al.
7,721,852 B2 * 5/2010 Ishioka ..... B66B 7/08 187/313
7,793,762 B2 9/2010 Zaharia et al.
8,028,807 B2 10/2011 Deplazes et al.
8,123,003 B2 2/2012 Meri et al.
8,307,953 B2 11/2012 Ferreira
8,418,815 B2 4/2013 Encinas Carreno et al.
8,464,841 B2 * 6/2013 Birrer ..... B66B 5/06 187/305
8,534,426 B2 * 9/2013 Smith ..... B66B 1/30 187/293
8,540,057 B2 * 9/2013 Schuster ..... B66B 1/34 187/247
8,678,143 B2 * 3/2014 Bunter ..... B66B 5/0025 187/247
8,807,248 B2 8/2014 Sonnenmoser et al.
8,893,858 B2 11/2014 Shi et al.
8,915,334 B2 * 12/2014 Finschi ..... B66B 1/2408 187/249
9,033,114 B2 5/2015 Mizon
9,529,089 B1 * 12/2016 Buether ..... G01S 19/49
2012/0055741 A1 3/2012 Katsura
2015/0014098 A1 1/2015 Stolzl et al.
2017/0101290 A1 * 4/2017 Kattainen ..... B66B 5/0031

OTHER PUBLICATIONS

Henning GMBH, "Liftpc Mobile Diagnosis", product brochure, pp. 1-12, Oct. 2, 2007, Schwelm, Germany.
Physical Measurement Technologies, "EVA-625 Elevator Vibration Analysis system", product brochure, p. 1, generated online Jul. 27, 2015, Marlborough, NH.
Madarasz, Mutch, "Continuous Performance Monitoring of Elevators", Elevator World, Aug 2008, p. 80-84.

* cited by examiner

ELEVATOR INSPECTION APPARATUS WITH SEPARATE COMPUTING DEVICE AND SENSORS

BACKGROUND OF THE INVENTION

The present invention is in the technical field of elevators. More particularly, the present invention is in the technical field of elevator performance analysis.

Elevators are among the most frequently and widely used modes of public transportation in developed countries. People rely on them as a convenience to quickly travel between floors in multi-story buildings. More importantly, elevators are essential to the existence of high-rise buildings. Elevators are also essential to transport people with certain physical disabilities within multi-story buildings.

Due to their critical importance, elevators must be safe, comfortable, and reliable. Elevator inspectors, consultants, and mechanics are employed to this end. To help ensure safety, The American Society of Mechanical Engineers (ASME) developed a "Safety Code for Elevators and Escalators", which is widely known within the elevator industry in the United States as ASME 17.1. This code establishes standard practices for the design, construction, installation, and operation of elevators and escalators. It is the responsibility of each state in the United States to establish laws regarding elevator safety. Most states do this by requiring that some or all of ASME 17.1 be followed within their state. To enforce the code, licensed elevator inspectors inspect every elevator according to a schedule specified by the state. While most of ASME 17.1 deals with other issues, portions of the code do cover the performance parameters of acceleration, speed, jerk, vibration, duty cycle, and door times, and an inspector may need to measure these parameters.

The National Elevator Industry, Inc. (NEII) publishes a document that specifies the criteria that are used to measure the performance of elevators. This document lists 50 criteria that are used by the industry for new and old elevators alike, some of which can be measured with instruments and others that are currently determined manually.

Elevators are complicated, specialized, and vary considerably from one to another. As a result, architects, building owners, and building managers often require the services of expert elevator consultants to assist with the design and management of their elevator systems. Elevator consultants frequently need to measure and analyze parameters of elevator performance, for example, to determine if an elevator is installed correctly or is being maintained correctly.

Elevator mechanics or technicians perform regular maintenance to keep an elevator operating safely and reliably. They also repair defective components, and install new elevator systems and components. During the course of these activities, they have a need to measure and analyze elevator performance parameters. For example, if passengers complain that the elevator "slips" during travel, the mechanic may measure the acceleration to determine when the problem occurs during the trip and its magnitude. As another example, the mechanic needs to measure and adjust the speed to meet specifications when the elevator is installed, and needs to repeat the procedure periodically throughout the life of the elevator.

Unlike mechanics, consultants and inspectors often do not have specific knowledge of, or access to, the elevator controller and mechanisms. In some cases, building owners themselves want to evaluate the performance of their elevators.

The parameters of elevator performance are well known but often difficult to measure. Those that are relevant to the current invention are: acceleration/deceleration, speed, jerk, vibration, trips, landings, door times, and duty cycle.

Acceleration is the rate at which the speed (velocity) of the elevator car changes over time. When the elevator car moves up to a higher landing, there is a positive acceleration as its speed (velocity) increases in the upward direction, followed by a negative acceleration (deceleration) as its speed decreases until the car is stopped. Acceleration exerts a force on the mechanical components of the elevator car and on passengers. If acceleration (or deceleration) is too great, passengers can experience discomfort or injury, and the elevator itself can be damaged. If acceleration is too low, passengers will perceive that the elevator is slow. Acceleration is measured with a device called an accelerometer. Accelerometers are widely available in many form factors and price ranges.

Speed is the distance traveled per unit of time. Buildings are designed with enough elevators traveling at sufficient speeds to guarantee minimal wait times during the busiest times. If the elevators do not meet their speed requirements, passenger wait times will become unacceptably long. Elevator speeds have traditionally been measured by a mechanic riding on top of the car while holding a tachometer against the guide rail. This is a dangerous procedure. More recently, devices have been developed that compute speed by taking the integral of the acceleration.

Jerk is the rate of change, or derivative, of acceleration. It is a factor in determining the comfort, or quality, of the ride for the elevator passenger. A "smooth" ride has low jerk. A ride with high jerk is uncomfortable, and may induce fear in passengers. Jerk is computed as the derivative of acceleration.

Vibration is oscillation about an equilibrium point. Along with jerk, it is a factor in determining the quality of the ride for the elevator passengers. Excessive vibration can cause passengers to complain of "swaying", "shaking", or "buzzing". Vibration is computed as the difference between the maximum and minimum acceleration values of the oscillating acceleration value. Because vibration can occur in three dimensions, a three-axis accelerometer is used, and vibration is computed along the three axes.

Landings are the vertical stopping positions of the elevator car. Recording the pattern of landings serviced over a period of time, such as "rush hour", or during an entire day, is necessary when analyzing traffic to determine if the elevators in a building are sufficient to meet the needs of passengers. Knowing the landing in conjunction with other parameters can help in identifying problems. For example, excessive vibration at an upper landing can mean that a hydraulic elevator is low on fluid. Landings are usually recorded manually by the person doing the testing.

A trip is the movement of the elevator car from one landing to another. Knowing the total number of trips per day is useful when setting maintenance schedules. The number of trips during busy times, and the number of trips to each landing, is useful when planning replacement or modernization of elevators. Trips can be tallied by a person riding in the car. They can be tallied automatically by recognizing computationally the start and end of a trip, such as by a pair of opposite accelerations.

Timing of the elevator car door is important. The ideal is a door that opens and closes quickly, and remains open no longer than necessary. At the same time, the door should not move so fast that passengers perceive it to be dangerous. To optimize the door motion, several door-related time periods need to be measured and adjusted. These are: 1) car stop until door starts to open; 2) door starts to open until door fully open; 3) door fully open until door starts to close; 4) door starts to close until door completely closed; 5) door completely closed until car begins to move. Door times are usually recorded by a person using a stop watch. Recently, sensors that determine the door positions have been used to automatically record door times.

The duty cycle is the percent of time the elevator car is moving relative to total time of operation. This is used to determine maintenance frequency. The duty cycle of elevators is typically estimated based upon expected traffic. Duty cycle is also a safety criteria specified in ASME 17.1.

The current methods that are used for gathering and analyzing these performance parameters all have drawbacks. Any method that requires a person to observe and record is subject to human error. Several existing tools can automatically record and analyze some of these parameters. Many of them are expensive, or are intended for permanent installation on a single elevator. Many are large and heavy systems. Some require electrical connection to the elevator controller or other electrical components which are not easily accessible. Many are very limited in the amount of data they can store. With performance parameters, recording only a few measurements is insufficient, as the values can vary considerably. Many measurements must be recorded and analyzed for accuracy.

There are many examples of systems that monitor the operation and performance of elevators that are connected to or integrated into the elevator control system.

The following patents cover systems that are connected to the controller and use test patterns for diagnostic and control purposes:

U.S. Pat. No. 4,002,973 discloses an elevator testing system. This is a removable system connected to the controller that sends a sequence of simulated signals that test the operation of the elevator. The behavior resulting from these signals is used to evaluate the elevator operation.

U.S. Pat. No. 4,330,838 discloses an elevator test operation apparatus. The apparatus uses a copy of the controller's program to provide simulated signals to the elevator. These signals are then used to tune the elevator, including the operation of the doors.

U.S. Pat. No. 4,458,788 discloses an analyzer apparatus for evaluating the performance of a number of elevators. The apparatus connects to the controller and counts the signals from components, such as call buttons and relays. These counts are compared to those of normal elevator operation U.S. Pat. No. 5,042,621 discloses a method and apparatus for the measurement and tuning of an elevator system. The method uses simulated components to provide signals for setting up partially installed elevators.

U.S. Pat. No. 5,257,176 discloses an apparatus for setting the control operation specifications for an elevator. The system gets the control parameters from the control and displays them to the user. The user can then change the parameters remotely.

U.S. Pat. No. 7,222,698 discloses an elevator arrangement for testing the brakes on an elevator. On demand, the elevator is started moving upward, the brakes are engaged, and the torque of the motor is measured. The time it takes for the torque to reach zero is indicative of the condition of the brakes.

U.S. patent application No. 2012/0055741 discloses a system and method for monitoring and controlling multiple elevators based on patterns. This is a supervisory system that interfaces to multiple elevator controllers and copies the same control pattern to each. Elevators are then monitored for deviations from the pattern to indicate possible changes to the control patterns.

The following patents cover systems connected to the controller that use the control's internal states for diagnostic and control purposes:

U.S. Pat. No. 4,418,795 discloses an elevator servicing method and apparatus. Electrical leads are connected to the control system to monitor signals. These signals are compared to the internal states of the control, and any abnormalities are recorded and reported.

U.S. Pat. No. 4,930,604 and European Pat. No. EP0367388 disclose an elevator diagnostic monitoring apparatus. The apparatus is connected to the outputs of the elevator controller and compares signals and states to known good operation.

U.S. Pat. No. 5,760,350 discloses a method for monitoring of elevator door performance. A hardware device connected to the door operator control of an elevator determines the state of the door. The device maintains a state machine and compares the actual signals to those of the state machine. The performance of the door is analyzed and reported.

The following patents cover systems connected to the controller that monitor internal signals for diagnostic and control purposes:

U.S. Pat. No. 3,781,901 discloses a method for evaluating elevator performance by recording the analog signal from a multi-turn potentiometer on the elevator motor's shaft. This is interpreted as the position of the elevator.

U.S. Pat. No. 4,512,442 discloses methods and apparatus for improving the servicing of an elevator system. The apparatus counts faults of the elevator controller, compares these to thresholds, and places service requests based on the results.

U.S. Pat. No. 4,697,243 discloses a method for servicing an elevator system remotely. Information from the controller is retrieved over communication means. An expert system is used to make inferences about the condition of the elevator for untrained personnel.

U.S. Pat. No. 5,027,299 discloses an apparatus for testing the operation of system components of an elevator by monitoring signals associated with hall and car calls. The system determines the correct operation of the elevator and incorporates the results in the controller program.

U.S. Pat. No. 5,431,252 discloses a method for digital recording and graphic presentation of the combined performances of elevator cars. Tachometer digital signals are captured from the elevator's motor and analyzed to produce a digital display of the elevator's position.

U.S. Pat. No. 5,787,020 discloses a procedure and an apparatus for analyzing elevator operation. The apparatus connects to the controllers of multiple elevators and determines the operational functions of each elevator. These are combined to create a normal sequence of signals, and elevators deviating from the norm are identified for potential maintenance.

U.S. Pat. No. 5,817,994 discloses a remote fail-safe control for an elevator. The remote control arrangement includes a wireless transmitter and a wireless receiver that that is connected to the elevator controller for the purpose of placing calls. It can be detached when not needed.

U.S. Pat. No. 6,330,935 discloses a maintenance method for elevators that schedules maintenance for components based on their usage. Signals from components and sensors in the elevator can be used to update the schedule for their maintenance automatically.

U.S. Pat. No. 6,604,611 discloses a condition-based, auto-thresholded elevator maintenance system. Based on statistics, the system generates variable thresholds for acceptable number of faults. Maintenance recommendation can then be issued.

U.S. Pat. No. 7,699,142 discloses a diagnostic system having a user-defined sequence logic map to monitor an elevator. The apparatus connects to the inputs and outputs of the control system. The user can define logic patterns of the control signals to identify abnormalities.

U.S. Pat. No. 7,712,587 discloses a system for monitoring elevators by using a virtual elevator group. Information from individual elevators which are distributed geographically is combined into a virtual elevator group to simplify maintenance scheduling. Landing information is tracked.

U.S. Pat. No. 7,793,762 discloses a destination entry passenger interface with multiple functions. This is a terminal for user entry to determine the best car for the trip. The system gets door times from the controller to help with the dispatch.

U.S. Pat. No. 8,028,807 discloses a system to remotely record maintenance operations for an elevator or escalator. The system retrieves information about the operation and status of the elevator from the controller to determine if a maintenance technician is working on site.

U.S. Pat. No. 8,123,003 discloses a method of determining the position of an elevator car using magnetic areas of opposite poles in the hoistway. The system determines the landing number and location using RFID tags. Magnet strips are then used for fine positioning at the landing.

U.S. Pat. No. 8,307,953 discloses a system and method of determining a position of an elevator car in an elevator shaft. A series of photo detectors along the inside of the hoistway receive a light signal from the elevator car. Resistors between the detectors are used to determine the floor landing location.

U.S. Pat. No. 8,418,815 discloses a system for remotely observing an elevator system. The system monitors the sounds inside of an elevator car. The sounds can be indicative of the status of the elevator. Sounds can be reproduced from recordings remotely.

U.S. Pat. No. 8,807,248 discloses an elevator with a monitoring system in which diagnostic information is captured from multiple microprocessors in each car. One microprocessor is used to receive controller commands, while the other monitors RFID tags and sends floor information back to the controller.

U.S. Pat. No. 8,893,858 discloses a method and system for determining the safety of an elevator. The system uses an accelerometer, a microphone, and an optional smoke detector. Measurements are compared to limits to determine if the elevator is running safely. Alarms are issued as necessary.

U.S. Pat. No. 9,033,114 discloses a method of determining the position of an elevator car by using an accelerometer. The distance traveled is calculated from the acceleration. To compensate for inaccuracies in the accelerometer, additional sensors in the hoistway are needed to calibrate the accelerometer for the location of landings.

U.S. patent application No 2015/0014098 discloses a method and control device for monitoring the movement of an elevator car. The system uses multiple speed and acceleration sensors mounted on the rollers of an elevator car to determine if the car speed is exceeding limits. The multiple sensors are used to redundantly check each other to determine the probability of a fault.

Using accelerometers in portable systems to determine certain elevator performance criteria has been common for many years. These devices address 11 of the 50 criteria specified by the NEII.

Korean Pat. No. KR20040106077 discloses a portable elevator performance analyzer. This device uses an accelerometer to measure vibration and sound in an elevator car. Performance parameters associated with acceleration are displayed.

U.S. Pat. No. 5,522,480 discloses a measurement pick-up to detect physical characteristics of a lift. This is a portable device with an acceleration transducer, a timer, and memory. It is used to test the emergency stop mechanism of an elevator, checking for excessive deceleration.

U.S. Pat. No. 7,004,289 discloses an elevator performance measuring device and method. The elevator performance meter is a portable instrument containing an accelerometer for measuring properties of the vertical movement of an elevator. It specifically measures velocity, acceleration, jerk and run duration as an elevator moves. It must be manually started and stopped by the user. Memory is limited to two trips Korean Pat. No. KR100758152 (B1) discloses a fault diagnosis method using analysis of vibration. The system uses statistics concerning ride quality and vibration to determine the probability of a fault in the elevator bearings.

The EVA-625 Elevator Vibration Analysis system from Physical Measurement Technologies, Inc. combines a three axis accelerometer in a single package with a computer processor, memory, storage, display, and battery. It measures acceleration and computes speed, jerk, and vibration. Its primary drawback is that it can record only 700 seconds of data. It is also a sizable system, in a 10.7"×9.7"×5.0" case, weighing 9.5 lbs.

The Liftpc® Mobile Diagnosis system from Henning GMBH, similar to the EVA-265, uses a three axis accelerometer to measure and analyze vibration and ride quality. It is used in conjunction with a laptop computer or portable terminal device to store its data. It must be manually started and stopped by the user.

Measuring the operation of the doors is important to the evaluation of elevator performance. Door measurements account for 24 of the 50 criteria specified by NEII. This is often difficult to perform without access to the elevator control.

U.S. Pat. No. 8,678,143 discloses an elevator installation using an accelerometer mounted on an elevator door to measure performance properties of the door. The single accelerometer is also used to measure the same vertical properties as the aforementioned accelerometer-based systems.

Some of the more difficult measurements to get concern the time to travel between landings in an elevator. These account for 4 of the 50 NEII criteria. This is often performed manually. Determining which landing the elevator is on without access to the elevator control relies on a combination of door, speed, and distance measurements. These measurements in isolation are prone to inaccuracies.

The QarVision Remote Elevator Diagnostic System by Qameleon Technology, Inc. uses an altimeter to independently determine the position of the elevator in the hoistway. It also uses an accelerometer and independent door sensors to compute the aforementioned performance measures. QarVision is a movable system, but not a portable one. QarVision includes a self-contained computer processor and memory resulting in a high cost. The primary drawback of QarVision is that it must be installed by elevator mechanics, preventing the use by elevator inspectors, consultants, and building owners.

The need exists for a system to measure elevator performance parameters that is small, lightweight, and inexpensive; can be installed inside the elevator car by inspectors and consultants without special access to the elevator system and without special tools; automatically measures, computes, and records the performance parameters for a very long period of time; and allows the user to recall, display, graph, and prepare reports of the elevator performance. The Elevator Inspection Apparatus With Separate Computing Device And Sensors described herein addresses these needs.

BRIEF SUMMARY OF THE INVENTION

The present invention is an apparatus for analyzing elevator performance. It comprises a sensor package, a computing device, a computer program, and a communication mechanism between the sensor package and the computing device.

To minimize the apparatus cost, the computing device is one of a number of commercially available, off-the-shelf devices that most individuals who work in the technical aspects of elevators would already possess. These devices are computers that are programmable and multi-purpose. Examples of such devices include, but are not limited to, laptop personal computers, desktop personal computers, smart phones, tablet computers, and personal digital assistants (PDAs). The components of these devices that are known in the art and that are necessary for the present invention are: one or more computing processors, memory, electronic storage for computer programs and files, an electronic display, a power source, and the ability to communicate with other devices and provide power to other devices. The communication ability may be either built in to the computing device, or it can be added by interfacing a communication device such as an adapter or modem through an existing port on the computing device.

The communication mechanism between the computing device and the sensor package can be any existing standard communications between computers and peripherals, or between computers and remote devices, that provide two-way communication and also provide power from the computing device to the sensor package. An example of such a communication mechanism is USB.

The sensor package is a small, lightweight, inexpensive device that comprises one or more three-axis accelerometers, an altimeter, a door sensor, and an interface to the communication mechanism that allows it to both communicate with and receive power from the computing device. The door sensor needs to determine if the door is closed, open, or moving. It can do this, for example, by using a proximity sensor and a color sensor placed on the door frame and pointing toward the door surface. If the proximity sensor detects that nothing is in front of it, the door must be open. If the color sensor detects a specific color patch placed to indicate that the door is closed, then the door must be closed. If neither is detected, then the door must be moving.

To minimize the size of the sensor package, the components are constructed from integrated circuits. All of the components are solid-state devices mounted on a single circuit board enclosed in a small box. The devices on the circuit board communicate digitally with each other using a standard interface protocol, such as I2C. A communication interface device on this circuit board converts the signals to and from the standard external communication mechanism and the internal protocol used in the sensor package.

The computer program resides in the computing device's electronic storage, and runs, at the user's command, in the one or more processors of the computing device. The computer program periodically requests and receives sensor values from the sensor package, uses the sensor values to compute the performance parameters, displays the sensor values and performance parameters to the user on the electronic display, stores the sensor values and performance parameters in a file and a database, and generates reports.

The sensor values that the computer program requests and receives, and the performance parameters that it computes, are as follows: 1) Acceleration from the accelerometer, used to compute acceleration, speed, jerk, vibration, trips, and duty cycle; 2) Altitude from the altimeter, used to compute landings and distances traveled; 3) Colors from the color sensor, and proximity from the proximity sensor, used to compute door position and door times.

BRIEF DESCRIPTION OF THE SEVERAL VIEWS OF THE DRAWING

Preferred embodiments of the invention are shown in the drawings, wherein.

DETAILED DESCRIPTION OF THE INVENTION

Figure 1:
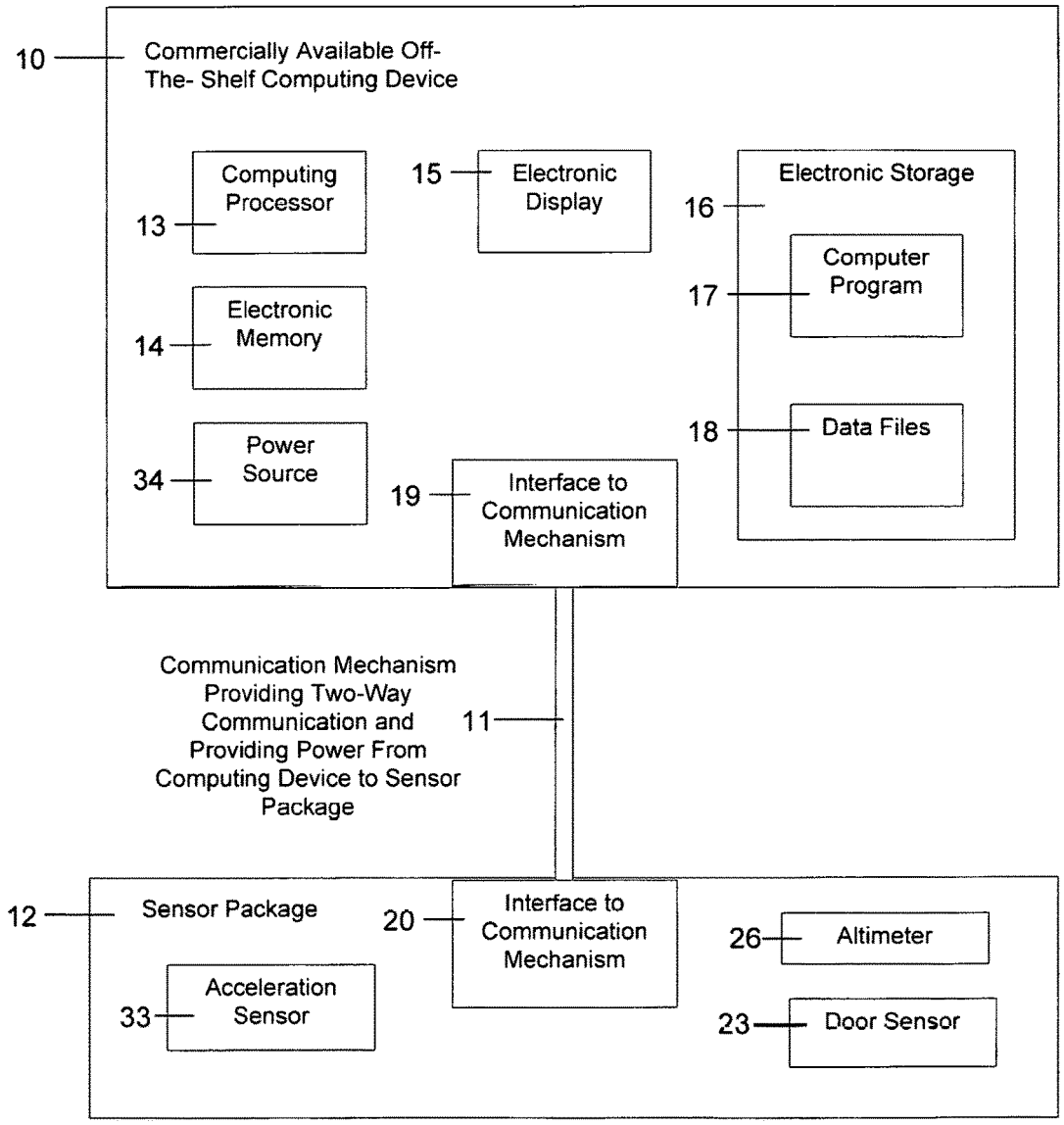
FIG. 1 is an overview of the apparatus for analyzing elevator performance.
Figure 2:
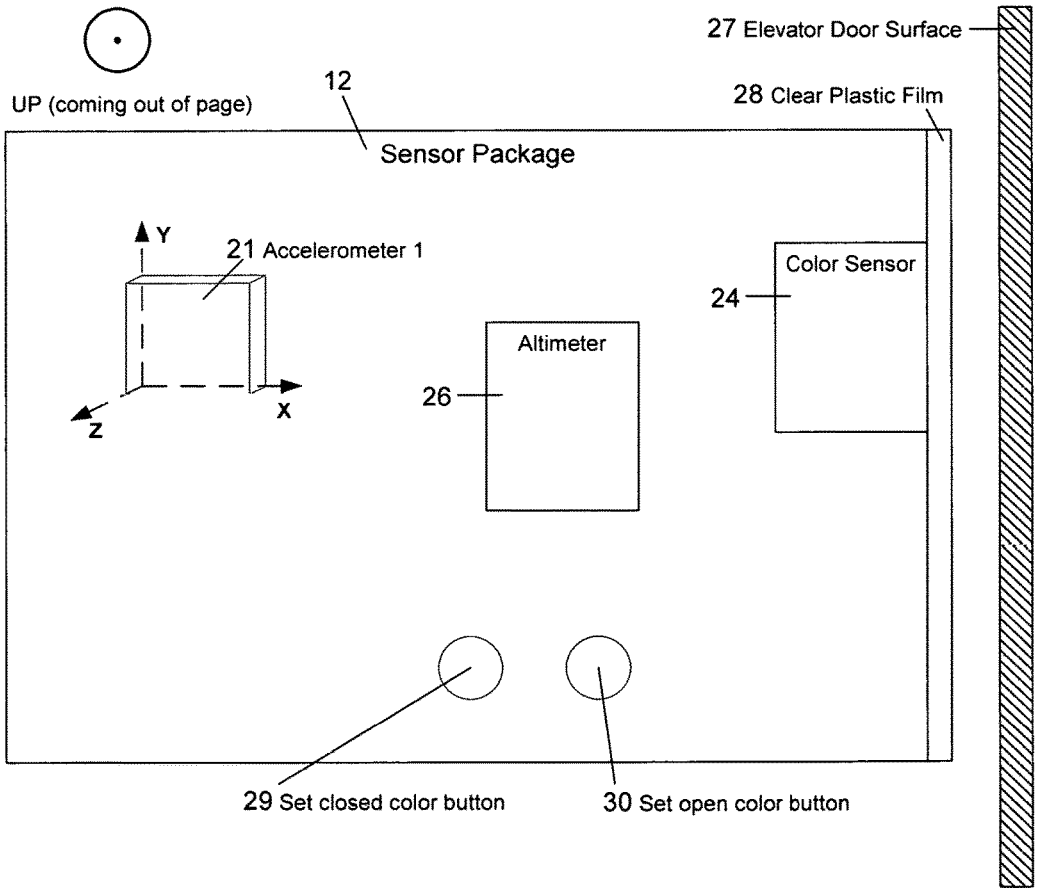
FIG. 2 shows the layout of the sensor package with one accelerometer and a color sensor used as a door sensor.
Figure 3:
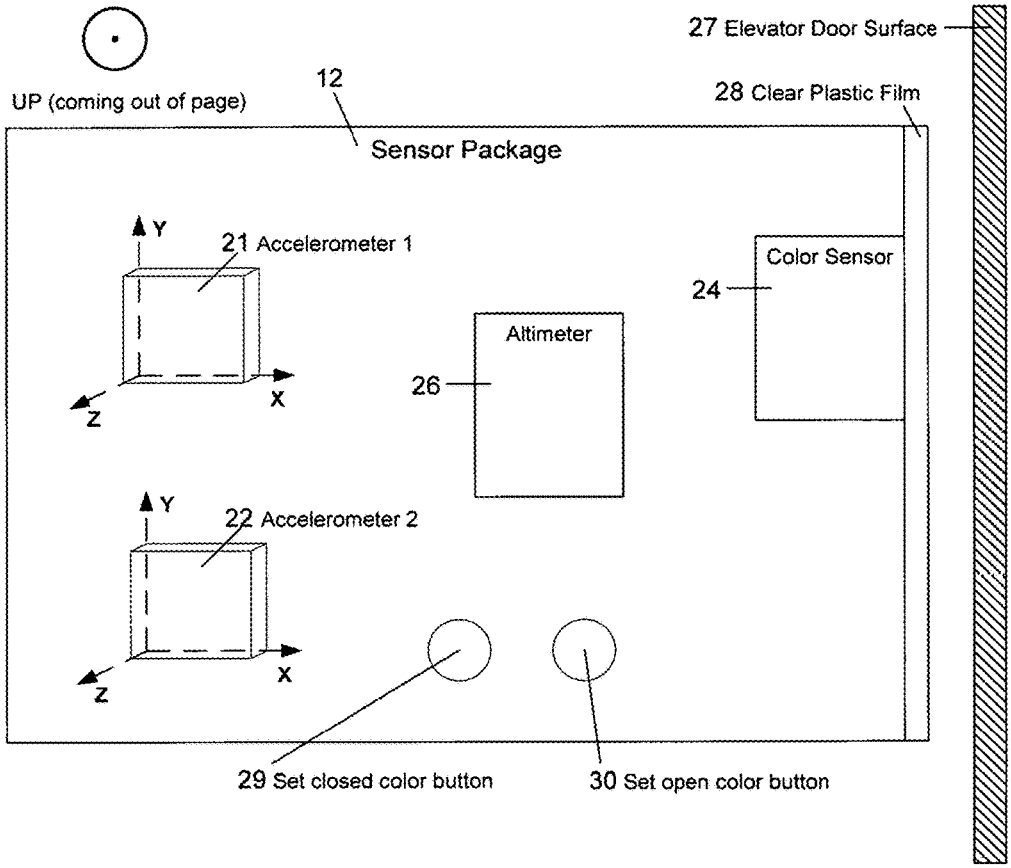
FIG. 3 shows the layout of the sensor package with at least two accelerometers and a color sensor used as a door sensor.
Figure 4:
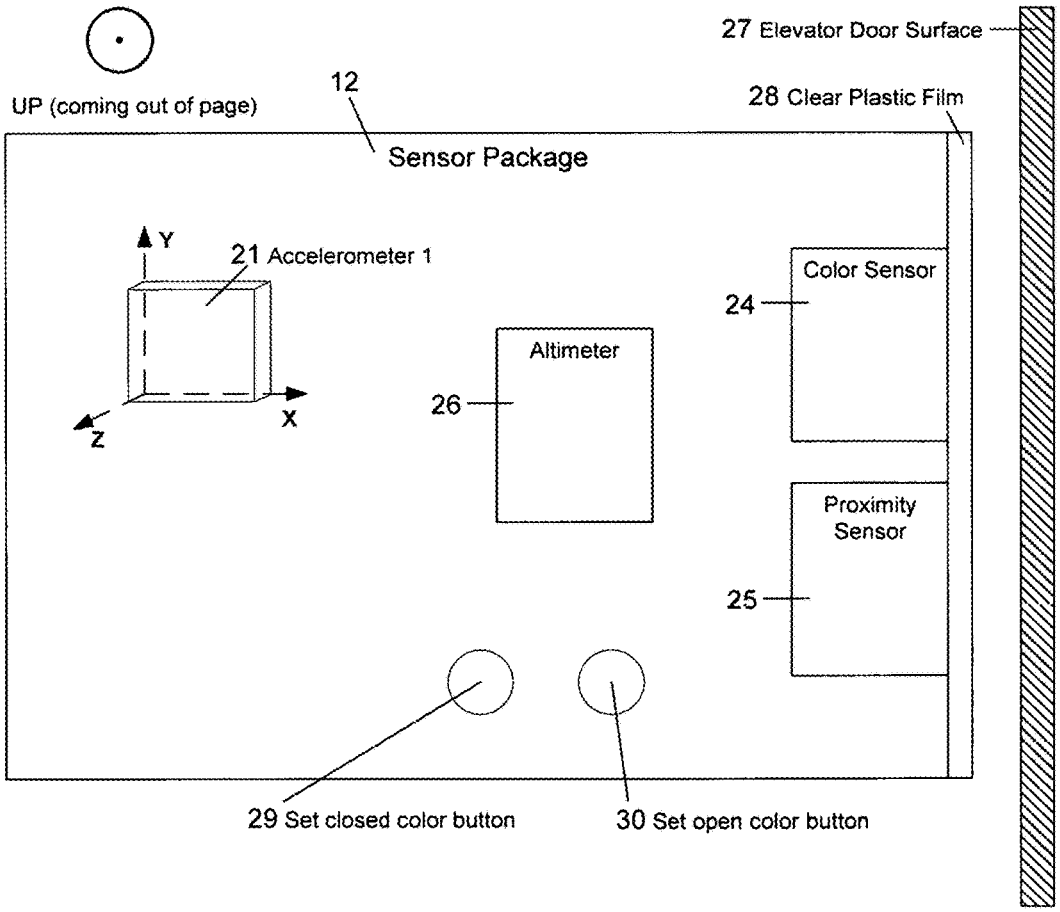
FIG. 4 shows the layout of the sensor package with one accelerometer and both a color sensor and proximity sensor used together as a door sensor.

FIG. 1 is an overview of the apparatus for analyzing elevator performance. With this apparatus, a user with their commercially available off-the-shelf computing device 10, attaches a communication mechanism 11 between the computing device 10 and the sensor package 12. The communication mechanism 11 provides two-way communication between the computing device 10 and the sensor package 12, and provides power from the computing device 10 to the sensor package 12.

It is known that a commercially available off-the-shelf computing device 10 includes: a computing processor 13 capable of running a computer program 17, electronic memory 14 used by the computing processor while running a computer program, electronic storage 16 for indefinitely storing data files 18 and the computer program 17, a power source 34, and an electronic display 15 capable of displaying graphics to a user. In addition, a computing device 10 commonly includes an interface to a communication mechanism 19, providing communication and power to another device, in this case a sensor package 12.

The sensor package 12 comprises an interface to a communication mechanism 20 providing communication and receiving power from the computing device 10, an acceleration sensor 33 comprising one or more three-axis accelerometers 21 and 22, a door sensor 23, and an altimeter 26. The one or more accelerometers 21 and 22 each provide acceleration values in the x, y, and z dimensions. The values from the one or more accelerometers in each dimension are averaged by the computer program 17, as will be described later, to provide a single value in each dimension. This is done to reduce errors. The altimeter 26 measures height above sea level based upon barometric pressure.

FIGS. 2-5 show the layout of the sensor package 12. The door sensor 23 comprises a color sensor 24 and optionally a proximity sensor 25. These sensors are sufficient to determine whether the door is fully open, fully closed, or moving.

The positive z-axes of the one or more accelerometers 21 and 22 are aligned with the vertical up direction of the sensor package 12 when the sensor package 12 is installed in the elevator car. The positive x-axes of the one or more accelerometers 21 and 22 are aligned with the horizontal axis of the sensor package 12 that will be perpendicular to the elevator door surface 27 when the sensor package 12 is installed in the elevator car. The positive y-axes of the one or more accelerometers 21 and 22 are aligned with the horizontal axis of the sensor package 12 that will be parallel with the elevator door surface 27 when the sensor package 12 is installed in the elevator car.

The color sensor 24 contains a near-white LED light source, and four light sensors. Three of the light sensors are filtered to admit light in a narrow band of wavelengths, with the first sensor filtered in the red band, the second sensor filtered in the green band, and the third sensor filtered in the blue band. The fourth light sensor is unfiltered, and is used to determine saturation. The color sensor 24 is mounted at the front edge of the sensor package 12 which will be closest to the elevator door surface 27. The LED and four light sensors are oriented so they will be perpendicular to the elevator door surface 27.

The proximity sensor 25 contains an LED that emits in the infrared range. It also contains a sensor that senses in the infrared range. When the sensor is near a surface, the infrared radiation from the LED is reflected to the sensor, which detects it. When the sensor is far from a surface, the infrared radiation is not reflected to the sensor. The proximity sensor 25 is mounted at the front edge of the sensor package 12 which will be closest to the elevator door surface 27. The LED and sensor are oriented so they will be perpendicular to the elevator door surface 27.

The altimeter 26 is mounted in the sensor package. Its orientation and position are not critical to the measurement of altitude. The housing of the sensor package 12 contains several small holes so that the air pressure will modulate quickly as the elevator car moves.

The housing of the sensor package 12 is opaque plastic on all sides except one. The side which will be mounted closest to the elevator door surface 27 is a thin clear plastic film 28, which allows the near-white LED light of the color sensor 24, and the infrared LED radiation of the proximity sensor 25, to pass freely out of and into the sensor package 12.

The sensor package 12 contains two buttons. The "set closed color" button 29 is pressed by the user to set the color that is used to indicate that the door is closed. The "set open color" button 30 is pressed by the user to set the color that is used to indicate that the door is open. This is described in greater detail later.

Figure 6:
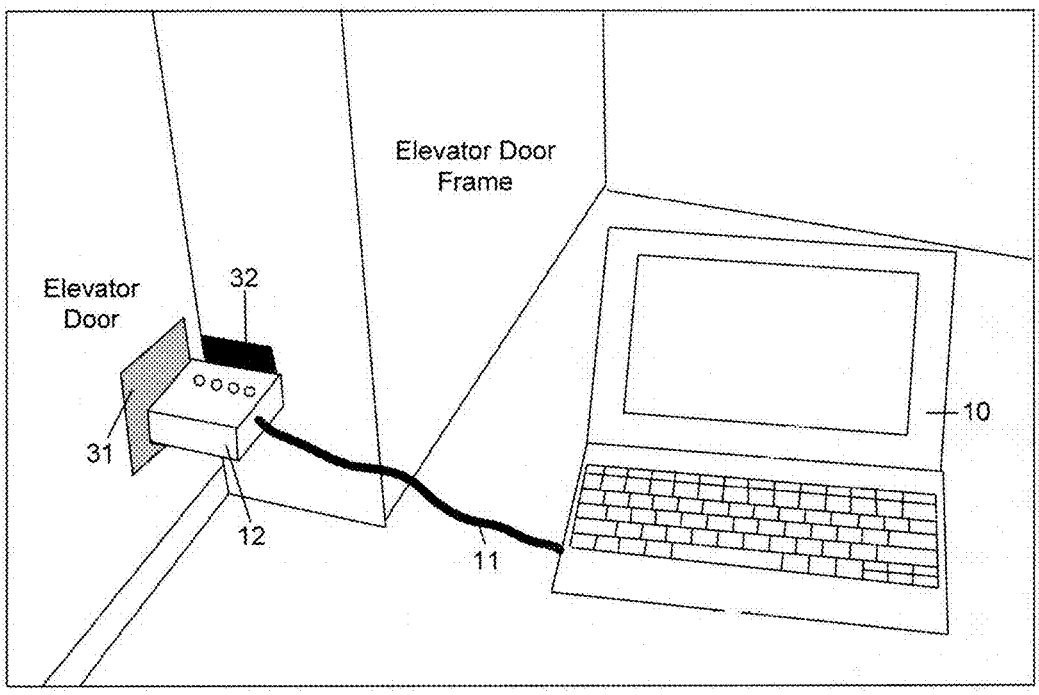
FIG. 6 shows the placement of the sensor package in the elevator car.

FIG. 6 shows the placement of the sensor package 12 in the elevator car. The sensor package is temporarily attached to any part of the elevator car that does not move when the door moves, such as the door frame, with the LED and color and proximity sensors pointed toward the door. A small L-shaped bracket 32 is used to hold the sensor package 12 in position. The sensor package 12 is attached to the bracket 32 using a temporary removable fastener system, such as Velcro®. The bracket 32 is then attached to the door frame using a temporary means, such as tape or magnets.

With the door in the closed position, a temporary target 31, such as a piece of paper or tape of a known color, is attached to the door in front of the color sensors. This is the reference for the door's closed position. The sensor package 12 is positioned at a distance from the door such that the proximity sensor detects the door's presence. This is the reference for the door moving.

The sensor package 12 is connected to the computing device 10 using a communication mechanism 11. The computing device 10 is placed on the floor or hand-held during operation of the apparatus.

Figure 7:
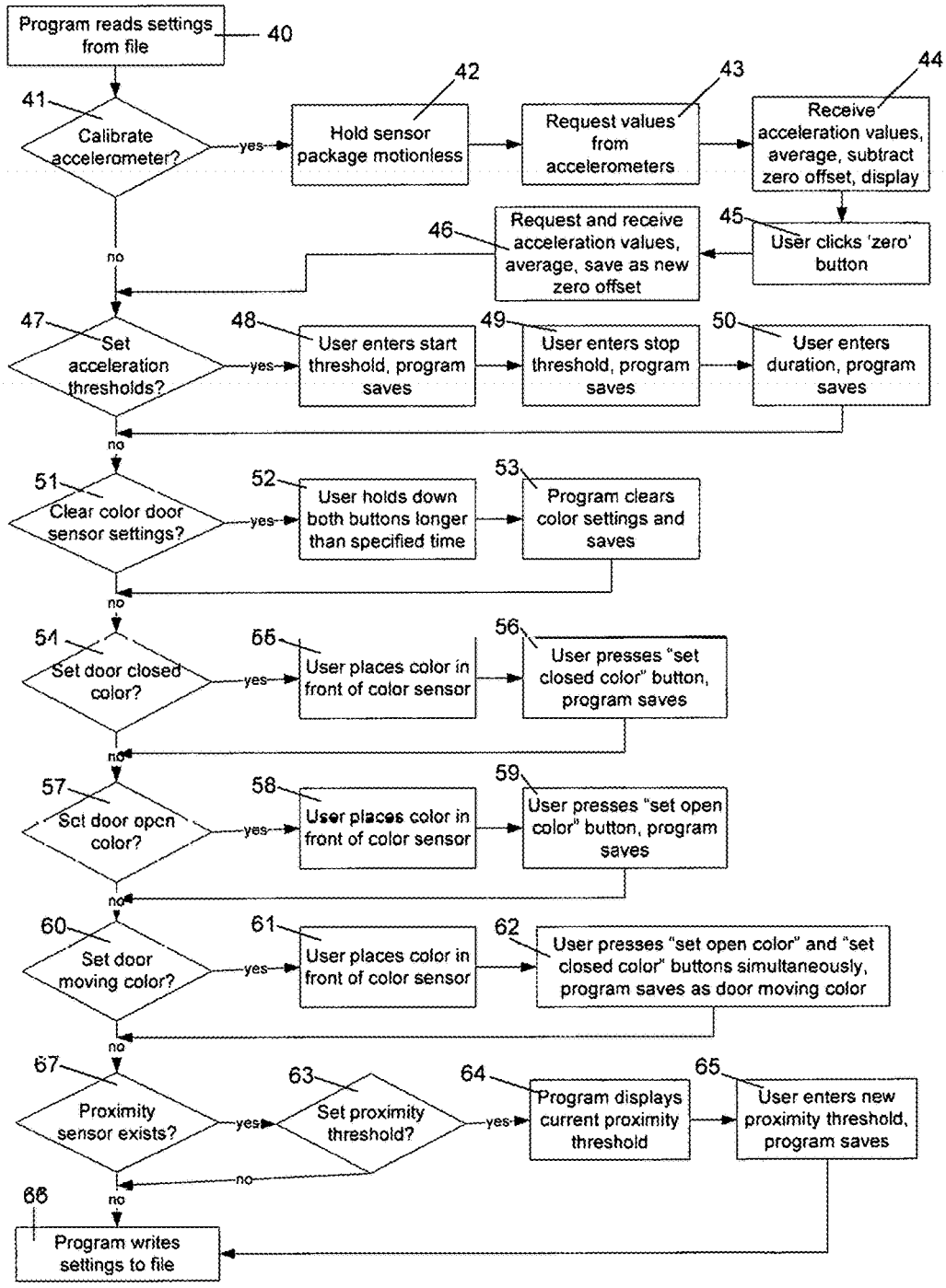
FIG. 7 shows the steps in the computer program that allow the user to specify settings for the system.
Figure 8:
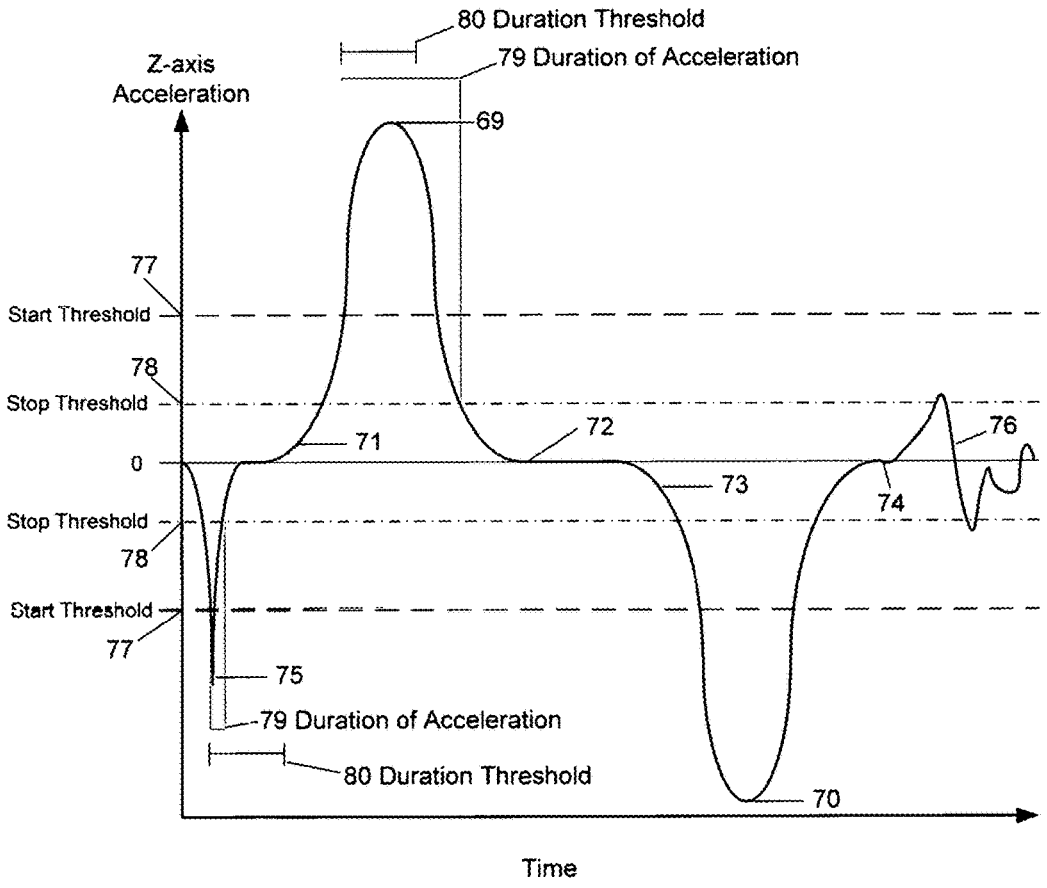
FIG. 8 shows a pair of accelerations that are used to define a trip.

When the user is ready to receive, view, and record elevator performance parameters, he/she starts the computer program 17 on the computing device 10. Several values that are required for the operation of the apparatus can be set by the user. These do not need to be set every time the program is started. FIG. 7 shows the steps involved.

The computer program first reads the previous settings from a file 40 stored in the computing device's electronic storage 16. Then the user can opt to set any of the values. Because the zero point can drift on an accelerometer, it may be necessary to calibrate the accelerometer 41 periodically. To calibrate the accelerometer, the user selects that option, selects which axis is to be calibrated, and ensures that the sensor package remains motionless 42 throughout the calibration procedure. The computer program then requests acceleration values along the specified axis from the one or more accelerometers 43. The program receives these values, averages them, adjusts by subtracting the previous zero point, and displays the difference to the user 44. When the user tells the program to calibrate the zero 45, the program again requests values from the one or more accelerometers, receives and averages them, and saves the result as the new zero point 46.

Figure 5:
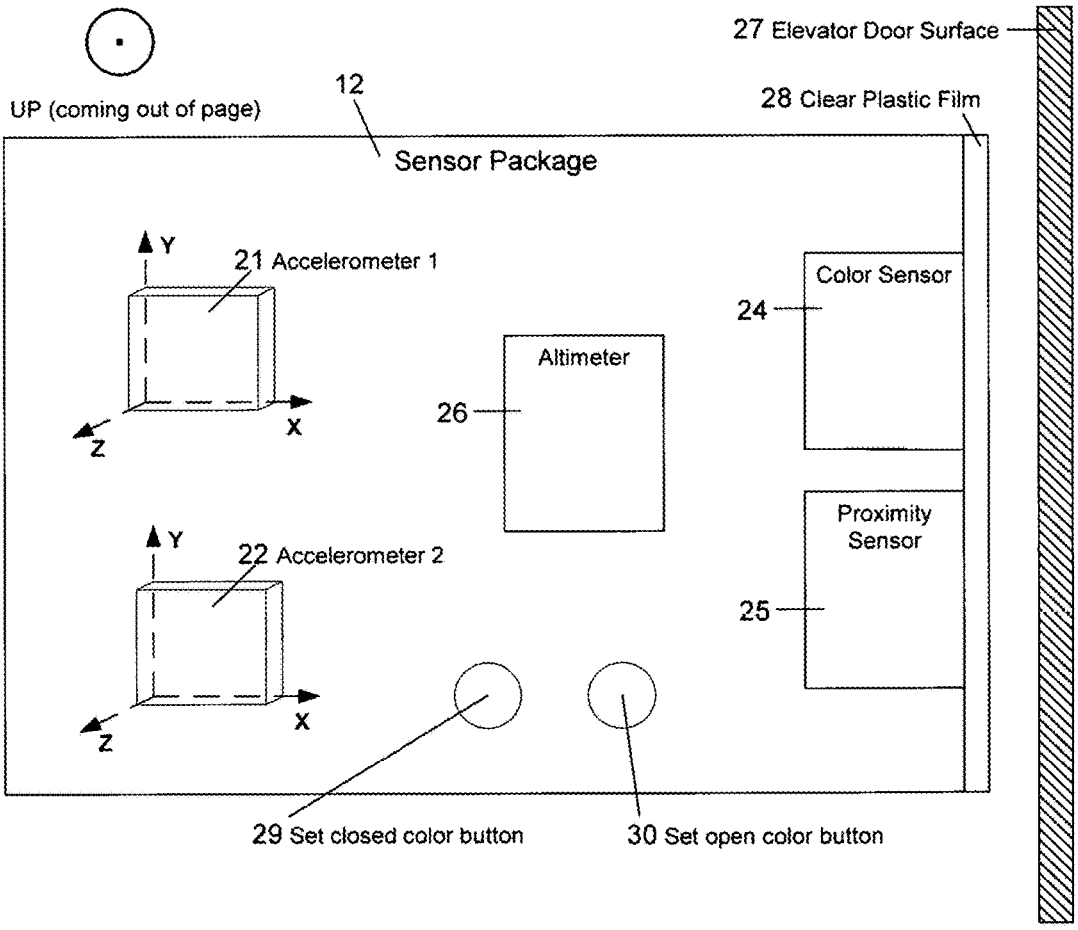
FIG. 5 shows the layout of the sensor package with at least two accelerometers and both a color sensor and proximity sensor used together as a door sensor.

The apparatus needs threshold values for acceleration so that it can detect the start and end of each elevator trip. An elevator trip begins when the car begins to move from a stopped state, and the trip ends when the elevator car stops moving. In this preferred embodiment, the trip is recognized by a pair of z-axis acceleration curves 69 and 70, in opposite directions, as shown in FIG. 5. When the car begins to move upward from a stop 71, the acceleration increases from zero in the positive direction, peaks 69, then drops to zero as the car reaches a constant speed 72. As the car begins to slow, acceleration increases in the negative direction 73, peaks 70, and returns to zero when the car stops 74. The result is a pair of acceleration curves, in opposite directions. When the car moves down, instead of up, the pair of acceleration curves is inverted, with the car first accelerating in the negative direction as it picks up speed, then accelerating in the positive direction as it slows to a stop.

Elevators often exhibit additional accelerations, which are not associated with the trip. For example, a heavy object being placed in the elevator car may cause a brief acceleration in the negative direction 75. As another example, the elevator doors opening and closing may cause vibration which results in acceleration in the car 76. To prevent using these in the detection of the trip, the computer program uses acceleration magnitude thresholds and an acceleration duration threshold. The start threshold 77 is an acceleration magnitude, which the absolute value of the acceleration in the z-axis must exceed. If the acceleration has exceeded the start threshold, the end of the acceleration is determined by its absolute value falling below the stop threshold 78. The duration of the acceleration 79 is the length of time between the start and end as determined by the start and end thresholds. To be considered an acceleration that is a component of a trip, the absolute value of the acceleration must exceed the start threshold, and the duration of the acceleration must exceed the duration threshold 80. Note that the brief negative acceleration 75 has a duration that is too short to be associated with a trip. Note also that the low magnitude accelerations 76 never exceed the start threshold, and so are not associated with a trip.

FIG. 7 shows the steps involved in setting the acceleration thresholds 47. The user enters the value of the start threshold 48 as an acceleration magnitude. The user next enters the value of the stop threshold 49 as an acceleration magnitude. Finally, the user enters the value of the acceleration duration 50 as a length of time. The program saves the values of the start, stop, and duration thresholds.

The user can clear all color door sensor settings 51, which include the three distinct colors to recognize that the door is closed, open, and moving. To clear these settings, the user presses both the "set closed color" 29 and "set open color" 30 buttons on the sensor package 12, and holds them down for at least a specified amount of time 52, for example, at least 7 seconds. The program then clears the settings, and saves the fact that each setting is cleared 53. If the user does this, he/she must then, at a minimum, set a closed door color, and either a proximity threshold or an open door color.

The user can set the color used to recognize that the door is closed 54. The user places the color, for example a colored piece of paper, in front of the color sensor 55, and then presses and releases the "set closed color" 29 button 56. The program saves the color value that it will use to recognize that the door is closed. Similarly, the user can set a color to be used to recognize that the door is open 57. This must be a different color than that used for the closed color. The user places the color to be used for open, for example a colored piece of paper, in front of the color door sensor 58, and then presses and releases the "set open color" 30 button 59. The program saves the color value that it will use to recognize that the door is open. Finally, the user can set a color to be used to recognize that the door is moving 60. This must be a different color than those used to recognize that the door is open or closed. The user places the color to be used for moving, for example, the surface of the door itself, in front of the color door sensor 61, then presses and releases both the "set closed color" 29 and "set open color" 30 buttons simultaneously 62. The computer program recognizes that both buttons are pressed and stores the color value that it will use to recognize that the door is moving.

If the proximity sensor exists 67, the user can set the proximity threshold 63, which will be used by the program to determine if a surface (the door) is near the proximity sensor. The proximity values returned by the proximity sensor are high when a surface is near, and low when no surface is near. When the door is open, the proximity sensor value should be less than the threshold. When the door is moving or closed, the proximity sensor value should be greater than the threshold. When the user selects to set the proximity threshold 63, the program displays the previously set threshold value 64. The user enters a new threshold value 65. The computer program saves the new proximity threshold. When the user is done updating settings, the program writes all settings to a file 66.

Figure 9:
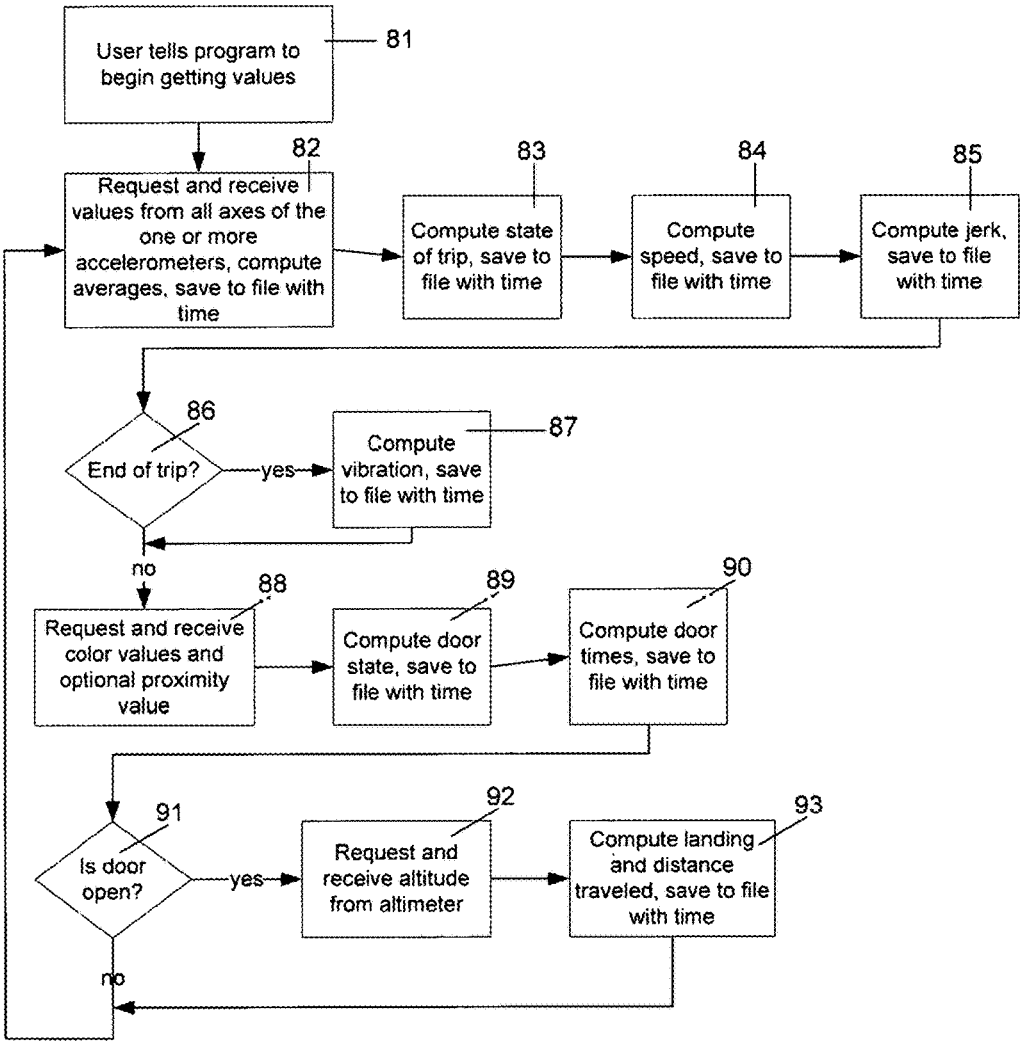
FIG. 9 shows the steps in the computer program that loop repeatedly to request and receive sensor values and display them to the user.

FIG. 9 shows the computer program's repetitive process of requesting and receiving sensor values from the sensor package, using those sensor values to compute performance parameters, and storing time, sensor values, and performance parameters in a file. At the user's command 81, the program begins the process. It first requests and receives the acceleration values from all three axes of the one or more accelerometers 82. It averages the values from the one or more accelerometers in the z axis, the x axis, and the y axis, to reduce errors, and saves the averaged values to the data file along with the time. It uses the averaged acceleration values to compute the state of the trip 83, speed 84, jerk 85, and, if this is the end of the trip 86, vibration 87. It saves these values to the data file, along with the time.

Figure 10:
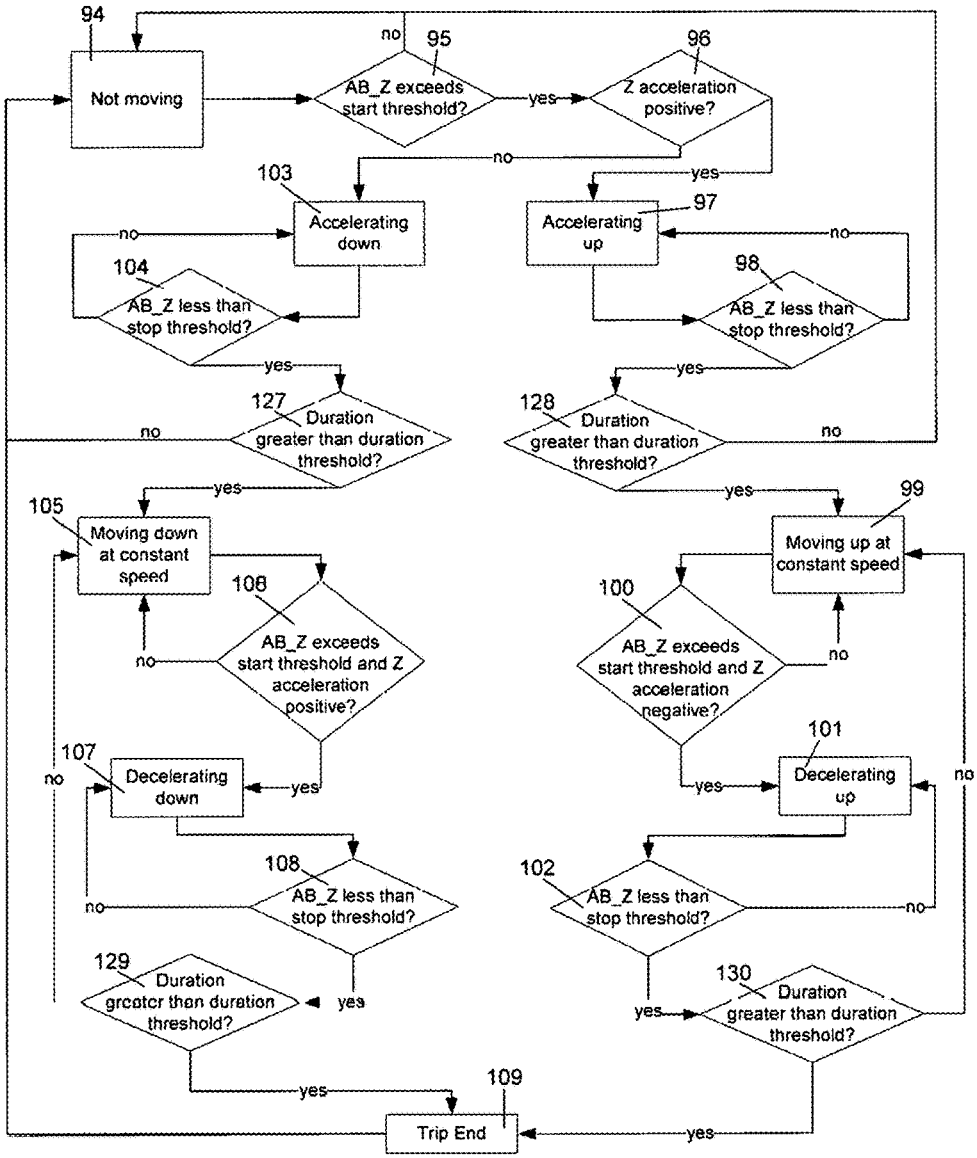
FIG. 10 shows the steps in the computer program that determine the state of each trip.

The program uses the current state of the trip, and the acceleration in the z axis, to determine the new state of the trip. FIG. 10 shows this process. Initially the car is not moving 94. When the absolute value of the z acceleration (AB_Z) is greater than the start threshold 95, the trip begins. If the sign of the z acceleration is positive 96, the car is accelerating up 97. If the sign is negative, the car is accelerating down 103. When AB_Z becomes less than the stop threshold 98 and 104, the car is no longer accelerating. If the duration of the acceleration is greater than the duration threshold 127 and 128, then the car is moving up 99 or down 105 at constant speed. If the duration of the acceleration is not greater than the duration threshold, the acceleration is not the beginning of a trip, and the elevator car is not moving 94. If the car is moving up at constant speed 99, it will begin decelerating 101 when AB_Z exceeds the start threshold, and the sign of the z acceleration is negative 100. If the car is moving down at constant speed 105, it will begin decelerating 107 when AB_Z exceeds the start threshold, and the sign of the z acceleration is positive 106. In both cases, deceleration continues until AB_Z falls below the stop threshold 102 and 108. If the duration of the deceleration is greater than the duration threshold 129 and 130, then the trip has ended 109, and the car is not moving 94. If the duration of the deceleration is not greater than the duration threshold, the elevator car is continuing to move up at constant speed 99 or down at constant speed 105.

Speed is the integral of acceleration over time. In the present invention, speed is calculated 84 by integrating the z axis acceleration over time. Integration of discrete values on computers is a well known technique, and will not be described further here.

Jerk is the derivative of acceleration over time. In the present invention, jerk is calculated 85 by taking the derivative of the z axis acceleration over time. Taking derivatives of discrete values on computers is a well known technique, and will not be described further here.

Vibration is computed 87 independently along each of the three acceleration axes at the end of each trip. Along each axis, a fast fourier transform (FFT) of the acceleration over time during a trip is computed. Large values in the resulting FFT correspond to vibration. This is a well known technique, and will not be described further here.

Figure 11:
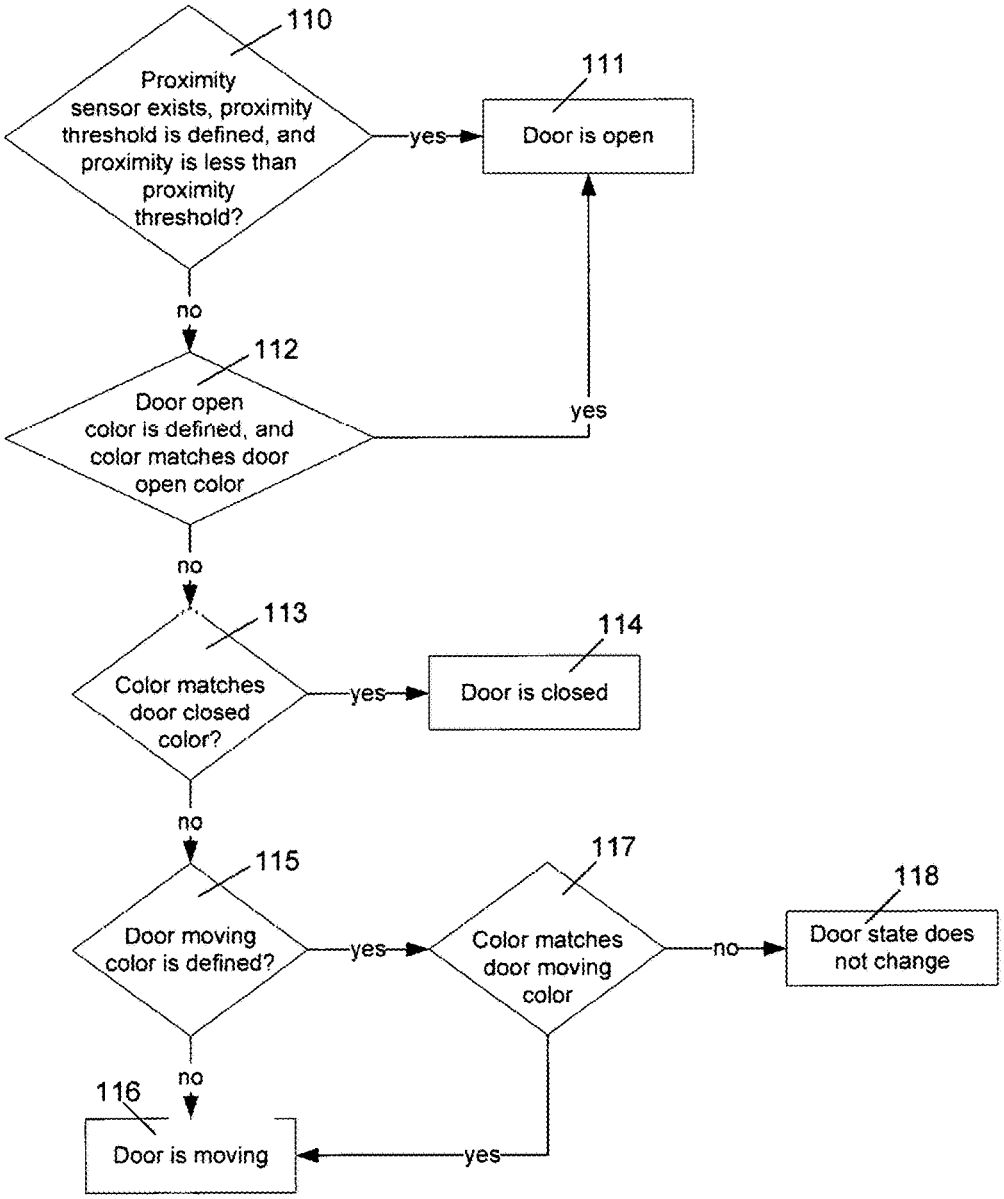
FIG. 11 shows the steps in the computer program that compute the state of the door.

The computer program next requests and receives the color values and optional proximity values from the color sensor and optional proximity sensor 88, as shown in FIG. 9. These values are used to compute the door state 89, that is, whether the door is closed, moving, or open. The program must have, at a minimum, a defined value for door closed color, and either a defined proximity threshold or a defined door open color, in order to determine the door state. The algorithm for determining door state is shown in FIG. 11. First, if the proximity sensor exists, and if the proximity threshold is defined, and if the current proximity value is less than the proximity threshold 110, then the door is open 111. Otherwise, if the door open color is defined, and the current color matches the door open color 112, then the door is open 111. Otherwise, if the current color matches the door closed color 113 (which must be defined), then the door is closed 114. Otherwise, if the door moving color is not defined 115, the door is moving 116. If the door moving color is defined 115, and the current color matches the door moving color 117, then the door is moving 116. If the door moving color is defined 115, and the current color does not match the door moving color 117, then the door state does not change 118.

As shown in FIG. 9, once the door state 89 is known, the program will compute door times and save them to the file 90. The door times it computes are: 1) car stop until door starts to open; 2) door starts to open until door fully open; 3) door fully open until door starts to close; 4) door starts to close until door completely closed; 5) door completely closed until car begins to move.

Figure 12:
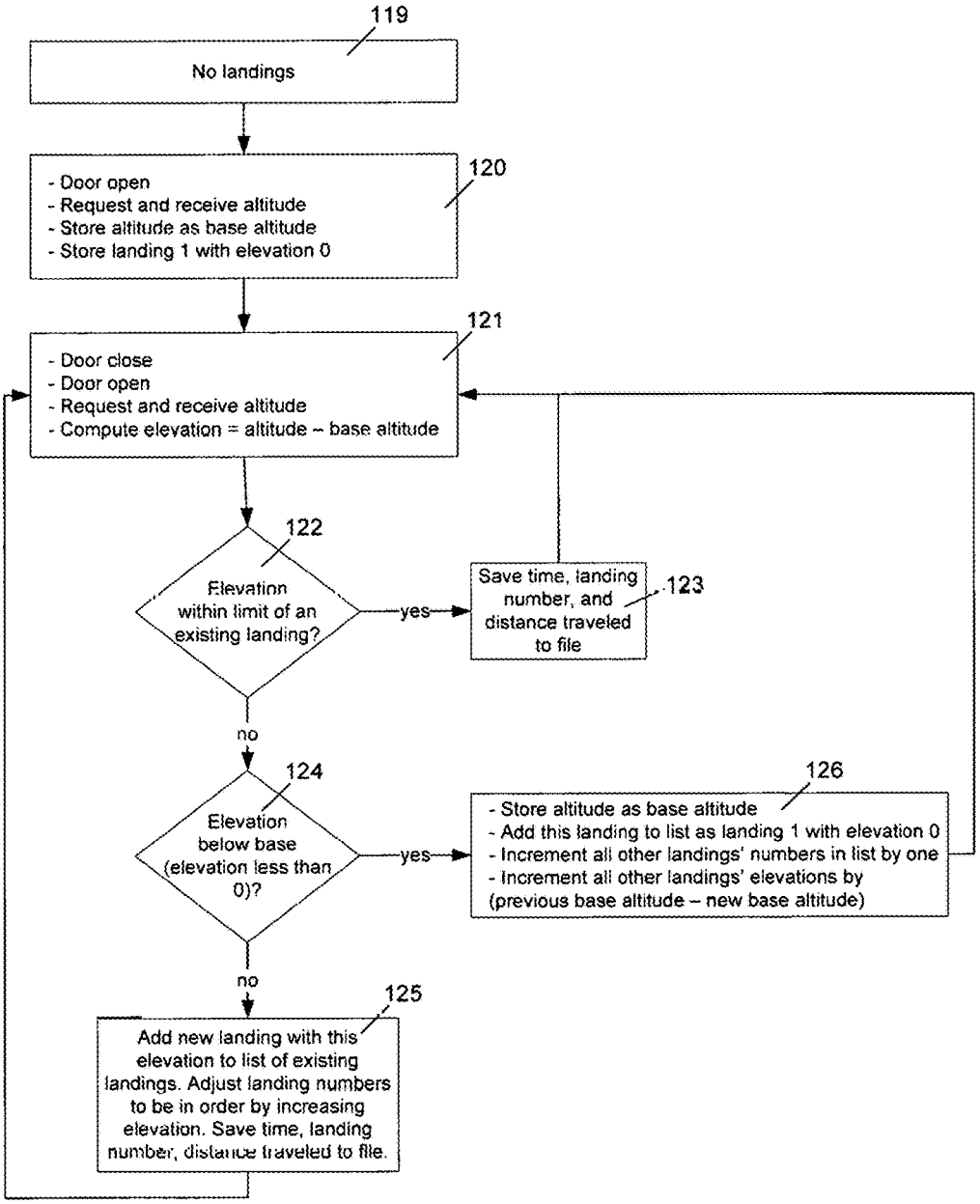
FIG. 12 shows the steps in the computer program that learn and determine the landing.

If the door state is open 91, the program will request and receive the altitude from the altimeter 92. It then computes the landing number, and the distance traveled from the previous landing, and saves these values to the data file 93. Initially, the program does not know how many landings exist, nor what their elevations are above the base (first landing). The program learns the number of landings, and their elevation above the base, using the method shown in FIG. 12. Initially, there are no known landings 119. When the door opens, the program requests and receives the altitude from the altimeter. The program stores this altitude as the base altitude for the elevator, and stores this landing as landing 1, with an elevation of 0 above the base 120. The door closes. At some future time, the door opens again, and the program requests and receives the altitude from the altimeter. The program computes the elevation of the present landing by taking the difference between the new altitude and the base altitude 121. If the elevation is within some fixed limit, for example 2 meters, of an existing landing's elevation 122, then the program saves to the data file the time, the landing number, and the distance traveled from the previous landing 123. If the elevation is not within the fixed limit of an existing landing, then this is a new landing, and the program checks if the elevation is below the base; in other words, if the elevation is less than zero 124. If not, the program adds a new landing to the list of landings, with the given elevation. It adjusts all landing numbers so they are in order by increasing elevation. It also saves to the data file the time, landing number and distance traveled from the previous landing 125. If instead the elevation is less than zero 124, this altitude is stored as the new base altitude, and this landing is added to the list of landings as the new landing number one with elevation zero. All other landing numbers are incremented by one, and their elevations are incremented by the difference between the previous base altitude and the new base altitude 126.

The user can ask the program to store the data in the data file to a data base, where it can more conveniently be analyzed. The program can display the data from the data base graphically or in list form, perform various calculations such as mean, median, min and max, and generate reports containing these computed values. These techniques for storing, manipulating, and displaying data are well known and will not be described further here.

As will be understood by those skilled in the art, many changes in the apparatus and methods described above may be made by the skilled practitioner without departing from the spirit and scope of the invention, which should be limited only as set forth in the claims which follow.

We claim:

1. An elevator inspection apparatus, comprising:

a commercially available off-the-shelf computing device comprising a computing processor for running computer programs, an electronic memory used by said computing processor while running a computer program, an electronic storage for indefinitely storing data files and computer programs, an electronic display for displaying graphics to a user, a power source, and an interface for communicating with and providing power to a physically separate sensor package;

a sensor package, physically separate from said computing device, comprising a sensor for measuring the acceleration of the elevator car, a door sensor for determining the position of the elevator door, an altimeter for measuring the altitude of the elevator car, and an interface for communicating with and receiving power from said computing device;

a communication mechanism between said computing device and said sensor package whereby said communication mechanism provides two-way communications between said computing device and said sensor package, and said communication mechanism provides power from said computing device to said sensor package;

a computer program stored in said electronic storage and running in said computing processor that repetitively requests acceleration measurements, door positions, and altitude measurements from said sensor package and analyzes said acceleration measurements, door positions, and altitude measurements, and manages the functions of said elevator inspection apparatus;

whereby said computer program computes the beginnings and ends of every trip of the elevator car so that the user need not indicate the beginnings and ends of any trip to said elevator inspection apparatus; and said computer program computes the accelerations, velocities, jerks, door positions, landings, trip start times, trip end times, trip directions, and trip durations of the elevator car for every trip, displays the results of the computations on said electronic display, and stores the results and times of the computations for every trip in said electronic storage so that the number of results that are stored is limited only by the size of said electronic storage.

2. The elevator inspection apparatus according to claim 1, wherein said sensor for measuring the acceleration of the elevator car is a three-dimensional accelerometer, whereby said computer program computes vibrations of the elevator car in three dimensions, displays results of vibration computations on said electronic display, and stores the results and times of the vibration computations for every trip in said electronic storage.

3. The elevator inspection apparatus according to claim 2, wherein said sensor for measuring the acceleration of the elevator car is at least two accelerometers, whereby said computer program repetitively requests acceleration measurements simultaneously from said accelerometers and computes a single acceleration measurement to reduce errors.

4. The elevator inspection apparatus according to claim 1, whereby said elevator inspection apparatus computes the duty cycle of the elevator car, displays results of the duty cycle computation on said electronic display, and stores the result and time of the duty cycle computation for every trip, and for the total period since said program started, in said electronic storage.

5. The elevator inspection apparatus according to claim 1, wherein said sensor package further comprising a non-contact door sensor for determining the position of the elevator door; whereby said computer program repetitively requests measurements from said door sensor to compute whether the status of the elevator door is open, moving, or closed; said computer program displays results of elevator door computations on said electronic display, and said computer program stores the results and times of the elevator door computations for every trip in said electronic storage.

6. The elevator inspection apparatus according to claim 5, whereby said computer program uses the start of each trip, the end of each trip, and the elevator door open, moving, or closed status, to compute the elevator door times of: elevator car stop until elevator door starts to open, elevator door starts to open until elevator door fully open, elevator door fully open until elevator door starts to close, elevator door starts to close until elevator door completely closed, and elevator door completely closed until elevator car begins to move; said computer program displays elevator door times on said electronic display, and said computer program stores the elevator door times for every trip in said electronic storage.

7. The elevator inspection apparatus according to claim 5, wherein said door sensor comprising: a color sensor for recognizing the presence of distinct colors, and a proximity sensor located physically close to said color sensor for detecting when a surface is near said proximity sensor; whereby the user affixes said sensor package to a position on the elevator car where said sensor package does not move when the door moves and where said proximity sensor detects the door surface is near when the door is closed or moving and said proximity sensor detects the door surface is not near when the door is open, and the user places a color patch on the door surface that is a distinctly different color than the door surface and is in view of said color sensor when the door is closed and is not in view of said color sensor when the door is moving or open; whereby said computer program recognizes that the door is closed when said color sensor detects said color patch, and said computer program recognizes that the door is open when said proximity sensor detects that the door surface is not near said proximity sensor, and said computer program recognizes that the door is moving when said color sensor does not detect said color patch and said proximity sensor detects that the door surface is near said proximity sensor.

8. The elevator inspection apparatus according to claim 5, wherein said door sensor comprising: a color sensor for recognizing the presence of distinct colors; whereby the user affixes said sensor package to a position on the elevator car where said sensor package does not move when the door moves, and the user places a first color patch on the door surface that is a distinctly different color than the door surface and is in view of said color sensor when the door is closed and is not in view of said color sensor when the door is moving or open, and the user places a second color patch on the door surface that is a distinctly different color than the door surface and a distinctly different color than said first color patch and is in view of said color sensor when the door is open and is not in view of said color sensor when the door is moving or closed; whereby said computer program recognizes that the door is closed when said color sensor detects said first color patch, and said computer program recognizes that the door is open when said color sensor detects said second color patch, and said computer program recognizes that the door is moving when said color sensor does not detect said first color patch and said color sensor does not detect said second color patch.

9. The elevator inspection apparatus according to claim 5, whereby said computer program requests measurements from said altimeter when the elevator door is open, compares the measurements to the altitudes of known landings of the elevator, finds the landing with the nearest altitude to the measured altitude; said computer program displays results of the elevator landing on said electronic display, and said computer program stores the results of the elevator landing and times for every trip in said electronic storage.

10. The elevator inspection apparatus according to claim 9, wherein said computer program learns the number of landings and the elevation of each landing above the first landing as it runs.

11. The elevator inspection apparatus according to claim 5, wherein said door sensor comprising: a color sensor for recognizing the presence of distinct colors, and a proximity sensor located physically close to said color sensor for detecting when a surface is near said proximity sensor; whereby the user affixes said sensor package to a position on the elevator car where said sensor package does not move when the door moves and where said proximity sensor detects the door surface is near when the door is closed or moving and said proximity sensor detects the door surface is not near when the door is open, and the user places a first color patch on the door surface that is a distinctly different color than the door surface and is in view of said color sensor when the door is closed and is not in view of said color sensor when the door is moving or open, and the user places a second color patch on the door surface that is a distinctly different color than the door surface and a distinctly different color than said first color patch and is in view of said color sensor when the door is open and is not in view of said color sensor when the door is moving or closed; whereby said computer program recognizes that the door is closed when said color sensor detects said first color patch, and said computer program recognizes that the door is open when said color sensor detects said second color patch, and said computer program recognizes that the door is open when said proximity sensor detects that the door surface is not near said proximity sensor, and said computer program recognizes that the door is moving when said color sensor does not detect said first color patch and said color sensor does not detect said second color patch and said proximity sensor detects that the door surface is near said proximity sensor.

* * * * *